US010830022B2

(12) United States Patent
Antonsen et al.

(10) Patent No.: US 10,830,022 B2
(45) Date of Patent: Nov. 10, 2020

(54) METHODS AND SYSTEMS FOR UTILIZING AN INNER DIAMETER OF A TOOL FOR JET CUTTING, HYDRAULICALLY SETTING PACKER AND SHUTTING OFF CIRCULATION TOOL SIMULTANEOUSLY

(71) Applicant: COMITT WELL SOLUTIONS US HOLDING INC., Katy, TX (US)

(72) Inventors: Roger Antonsen, Houston, TX (US); Mohamed Ibrahim Saraya, Sugarland, TX (US); Eivind Moen, Houston, TX (US)

(73) Assignee: COMITT WELL SOLUTIONS US HOLDING INC., Katy, TX (US)

( * ) Notice: Subject to any disclaimer, the term of this patent is extended or adjusted under 35 U.S.C. 154(b) by 55 days.

(21) Appl. No.: 16/213,471

(22) Filed: Dec. 7, 2018

(65) Prior Publication Data

US 2019/0106968 A1 Apr. 11, 2019

Related U.S. Application Data

(63) Continuation of application No. 15/284,913, filed on Oct. 4, 2016, now Pat. No. 10,184,325.

(51) Int. Cl.

| | |
|---|---|
| ***E21B 43/114*** | (2006.01) |
| ***E21B 34/10*** | (2006.01) |
| ***E21B 33/124*** | (2006.01) |

(52) U.S. Cl.

CPC ..... *E21B 43/114* (2013.01); *E21B 33/1243* (2013.01); *E21B 34/10* (2013.01)

(58) Field of Classification Search

CPC .... E21B 33/128; E21B 33/1243; E21B 43/11; E21B 43/25; E21B 43/26; E21B 43/114; E21B 43/267; E21B 34/10

See application file for complete search history.

(56) References Cited

U.S. PATENT DOCUMENTS

| | | | | |
|---|---|---|---|---|
| 6,533,037 B2 * | 3/2003 | Eslinger | ..... | E21B 43/26 166/319 |
| 2012/0186816 A1 * | 7/2012 | Dirksen | ..... | E21B 7/208 166/297 |
| 2015/0027724 A1 * | 1/2015 | Symms | ..... | E21B 34/16 166/373 |

* cited by examiner

*Primary Examiner* — David Carroll

(74) *Attorney, Agent, or Firm* — Pierson Intellectual Property LLC

(57) ABSTRACT

Examples of the present disclosure relate to systems and methods for utilizing an inner diameter of a tool for jet cutting and hydraulically setting packer.

13 Claims, 3 Drawing Sheets

METHODS AND SYSTEMS FOR UTILIZING AN INNER DIAMETER OF A TOOL FOR JET CUTTING, HYDRAULICALLY SETTING PACKER AND SHUTTING OFF CIRCULATION TOOL SIMULTANEOUSLY

BACKGROUND INFORMATION

Field of the Disclosure

Examples of the present disclosure relate to systems and methods for utilizing an inner diameter of a tool for jet cutting and hydraulically setting packer.

Background

Hydraulic injection is a method performed by pumping fluid into a formation at a pressure sufficient to create fractures in the formation. When a fracture is open, a propping agent may be added to the fluid. The propping agent, e.g. sand or ceramic beads, remains in the fractures to keep the fractures open when the pumping rate and pressure decreases.

Conventionally, it is required to insert a water jet cutter inside casing to create perforations within the casing. Once the perforations within the casing are created, the water jet cutter may be removed from the casing, and a tool is inserted into the casing, wherein the tool is positioned based on the locations of the perforations in the casing. To generate sufficient pressure to create the fractures in the formations, the tool utilizes a packer to isolate a zone of interest. The packers are conventionally set Mechanically through manipulating the string, i.e.: moving up, moving down, rotation or combination of these three movement To this end, conventional systems require a jet cutter and a mechanical packer to create the perforations within the casing and to isolate zones above from zones below before treating.

Accordingly, needs exist for system and methods for fracturing systems that hydraulically set packers via fluid flowing through an inner diameter of a tool, and jet cutters using fluid flowing through the same inner diameter of the tool to perforate a casing, hence eliminating the need of mechanical manipulation which can be challenging for horizontal wells.

SUMMARY

Examples of the present disclosure relate to systems and methods for utilizing an inner diameter of a tool for jet cutting and hydraulically setting packer.

In embodiments, a tool may include an inner diameter, flow activated valve, packers, and jet cutters, wherein the tool may be configured to be positioned within an unperforated casing.

The inner diameter of the tool may be a hollow passageway that extends from a proximal end of the tool to the distal end of the tool. The inner diameter of the tool may be configured to allow fluid to flow through the tool, from the proximal end of the tool to the distal end of the tool, as well as from the distal end of the tool to the proximal end of the tool.

The flow activated valve may be a moveable stop configured to block, limit, impede, etc. the flow of fluid through the inner diameter of the tool. The flow activated valve may be configured to be positioned proximate to the distal end of the tool. In a first mode, the flow activated valve may not cover the distal end of the tool. In a second mode, the flow activated valve may cover the distal end of the tool.

The packers may be sealing elements that are configured to seal radially. In the first mode, the packers may be configured to not seal across an annulus between an outer diameter of the tool and an inner diameter of the casing. In the second mode, the packers may be configured to seal across the annulus.

The jet cutters may be a device configured to perforate the casing using a high pressure jet of fluid. The jet cutters may be positioned on the tool, and may be configured to perforate the casing. The jet cutters may be configured to utilize fluid flowing through the inner diameter of the tool.

In embodiments, a first type of fluid may be configured to flow through an inner diameter of the tool. Responsive to the first type of fluid flowing through the inner diameter of the tool at a flow rate that is above a flow rate threshold, the flow activated valve may dynamically move from the first mode to the second mode. Moving the flow activated valve from the first mode to the second mode may create a pressure difference between the inner diameter of the tool and the annulus, which may cause the packers to radially seal across the annulus. When the packers are set and radially sealing, a second type of fluid may flow through the inner diameter of the tool and through the jet cutters. The jet cutters and the second type of fluid may perforate the casing.

Once the casing is perforated, a third type of fluid may flow through the annulus to perform a fracturing process within a geological formation. While the third type of fluid is flowing through the annulus, fluid may simultaneously be flowing through the inner diameter of the tool to maintain a positive pressure level within the inner diameter of the tool to maintain the packers in the second mode.

Then, in embodiments, fluid flowing through the inner diameter of the tool may cease or be reduced in conjunction with flowing fluid in annulus. This may cause the packer to automatically return to the first mode from the second mode; allowing the fluid in annulus to be circulated or reverse circulated back to surface. The tool may then move to a next zone for treatment, which may be a higher or lower zone.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
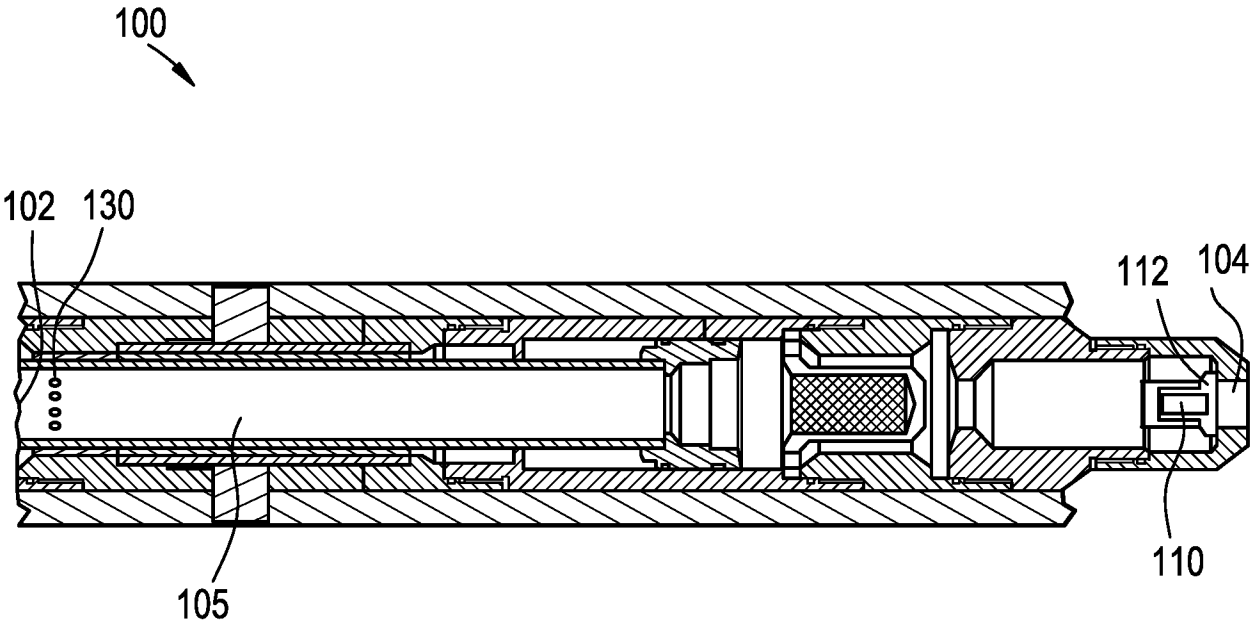
FIG. 1 depicts a tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a tool 100, according to an embodiment. An inner diameter 105 of tool 100 may be utilized for jet cutting and hydraulically setting packer. Tool 100 may include a hollow chamber defined by an inner diameter 105 extending from a proximal end 102 of tool 100 to a distal end 104 of tool 100. Inner diameter 105 may be configured to allow fluid to flow through tool 100, from the proximal end 102 to the distal end 104, as well as from the distal end 104 of the tool to the proximal end 102. Fluid may be pumped through inner diameter 105 of tool 100 to activate and deactivate the tool 100, and also to allow a jet cutting process to be performed. The fluid may move tool 100 from a first mode (activated) to a second mode (deactivated). When fluid ceases to flow within the inner diameter 105 of tool 100 or the fluid flow rate within the inner diameter 105 of tool 100 drops below a flow rate threshold, tool 100 may move from the second mode to the first mode. Tool 100 may include a flow activated valve 110, packer 120, and jet cutters 130.

Flow activated valve 110 may be a valve configured to be positioned proximal to distal end 104 of tool 100. However, flow activated valve 110 may be any type of closing mechanism, which enables packer 120 to be hydraulically set based on fluid flowing through inner diameter 105. Flow activated valve 110 may include a valve 112 that is configured to move in a linear or nonlinear axis parallel to the longitudinal axis of tool 100, wherein valve 112 may be any form of sealing mechanism. In the first mode, valve 112 may be configured to not cover the distal end 104 of tool 100. In the second mode, valve 112 may be configured to cover and seal the distal end 104 of tool 100. Responsive to valve 112 covering distal end 104 of tool 100, packer 120 may be set. Responsive to valve 112 not covering distal end 104, packer 120 may be unset. In embodiments, flow activated valve 110 may move from the first mode to the second mode by flowing a first type of fluid through the inner diameter 105 at a flow rate that is higher than a first flow rate threshold. The flow activated valve 110 may remain in the second mode as long as the flow rate within inner diameter 105 is higher than a second flow rate threshold. Responsive to the flow rate within inner diameter 105 being at pre-determined flow rate threshold, flow activated valve 110 may move from the second mode to the first mode.

Packer 120 may be sealing elements that are configured to be hydraulically set and unset. When packer 120 are set, packer 120 seal radially from an outer diameter of tool 100. When valve 112 covers the distal end 104 of tool 100 based on the fluid flow rate through inner diameter 105, packer 120 may be set, extend across an annulus, and engage a wellbore wall. Packer 120 may be unset by limiting the fluid flow rate through inner diameter 105 in conjunction with annular fluid flow, which may move valve 112 from the second mode to the first mode. When packer 120 is unset, packer 120 may not extend across the annulus. This may equalize the pressure above and below the packer within the annulus.

Jet cutters 130 may be a device configured to perforate a casing surrounding tool 100 using a high pressure jet of fluid. Jet cutters 130 may be orifices within tool 100 that allow fluid to flow through inner diameter 105, through the orifices, across the annulus, and perforate the casing. In embodiments, jet cutters 130 may be any device that is configured to focus a high pressure of fluid into a beam. Jet cutters 130 may be positioned at even intervals or uneven intervals along the circumference of tool 100. In embodiments, jet cutters 130 may be positioned closer to the proximal end 102 of tool than packer 120 and flow activated valve 120. In embodiments, jet cutters 130 may utilize a second type of fluid, which may be different than the first type of fluid or the same type of fluid as the first type of fluid, to perforate the casing. While jet cutters 130 are using the second type of fluid to perforate the casing, the fluid flow rate through the inner diameter 105 may remain above or below the second flow rate threshold of the lower.

Figure 2:
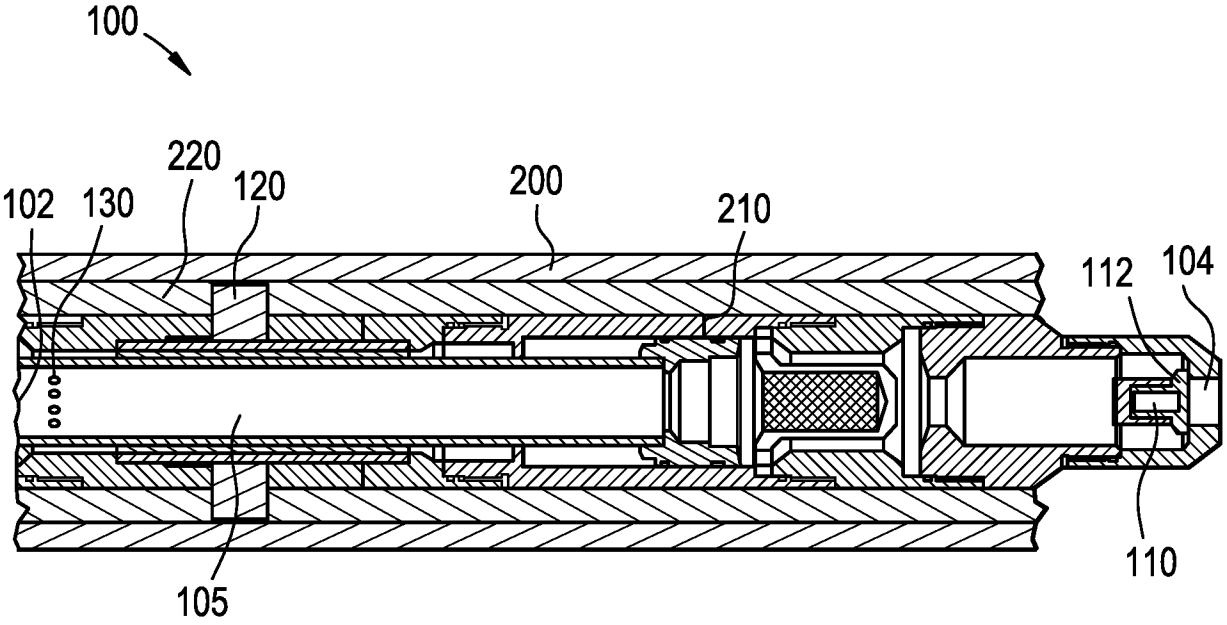
FIG. 2 depicts a tool positioned within a casing, according to an embodiment.

FIG. 2 depicts tool 100 in the second mode, according to an embodiment. Elements depicted in FIG. 2 may be substantially similar to those described above. Therefore, for the sake of brevity a further description of these elements is omitted.

As depicted in FIG. 2, tool 100 may be positioned within a casing 200. Casing 200 may be a tube, pipe, etc. extending from a surface level into a geological formation. Casing 200 may be substantially cylindrically in shape, and may or may not initially have any perforations. Casing 200 may have a first diameter that is larger than a second diameter corresponding with tool. Accordingly, when tool 100 is positioned within casing 200, casing 200 encompasses tool 100, and an annulus 220 may be created between an outer surface 210 of tool 100 and an inner surface of casing 200.

Responsive to a fluid flow rate within the inner diameter 105 of tool 100 being above the first flow threshold, flow activated valve 110 may activate by sealing distal end 104 of tool 100. By sealing distal end 104 of tool 100, the pressure within the inner diameter of tool 105 may increase, causing packer 120 to hydraulically set. When packer 120 are set, packer 120 may extend across the annulus 220 and seal the annulus above from annuls below the packer.

When packer 120 are hydraulically set, a second type of fluid may flow through inner diameter 105. The fluid my flow through inner diameter 105 and out of jet cutters 130 to perforate casing 200. In embodiments, the second type of fluid may be water or other liquid that is optimized to create the perforations within casing 200. Casing 200 may be perforated at locations corresponding to the positioning of jet cutters 130 on tool 100, such that the positioning the perforations may be known. While jet cutters 130 are perforating casing 200, a certain pressure differential is created across the jet cutter allowing the packer to stay set.

After the casing is perforated, a third type of fluid may flow through annulus 220 to perform a fracturing process within the geological formation through the perforations. While the third type of fluid is flowing through the annulus 220, fluid may simultaneously be flowing through inner diameter 105 of tool 100 and out from the jet cutter to maintain a positive pressure level within the inner diameter of tool 100, which may or may not be above the second fluid flow threshold. This may maintain the flow activated valve 110 in the closed position, such that packer 120 remain set. Then, when the fluid flowing through inner diameter of tool 105 is reduced below a certain threshold or when it cease to flow in conjunction with annular fluid flowing, this may cause the flow activated valve 110 to return to the first mode from the second mode, and also cause packer 120 to be unset automatically. When the flow activated valve 110 is returned to the first mode and packer unset, fluid positioned within annulus 220 may return to a proximal end 102 of tool 100 through the distal end 104 in tool 100.

Figure 3:
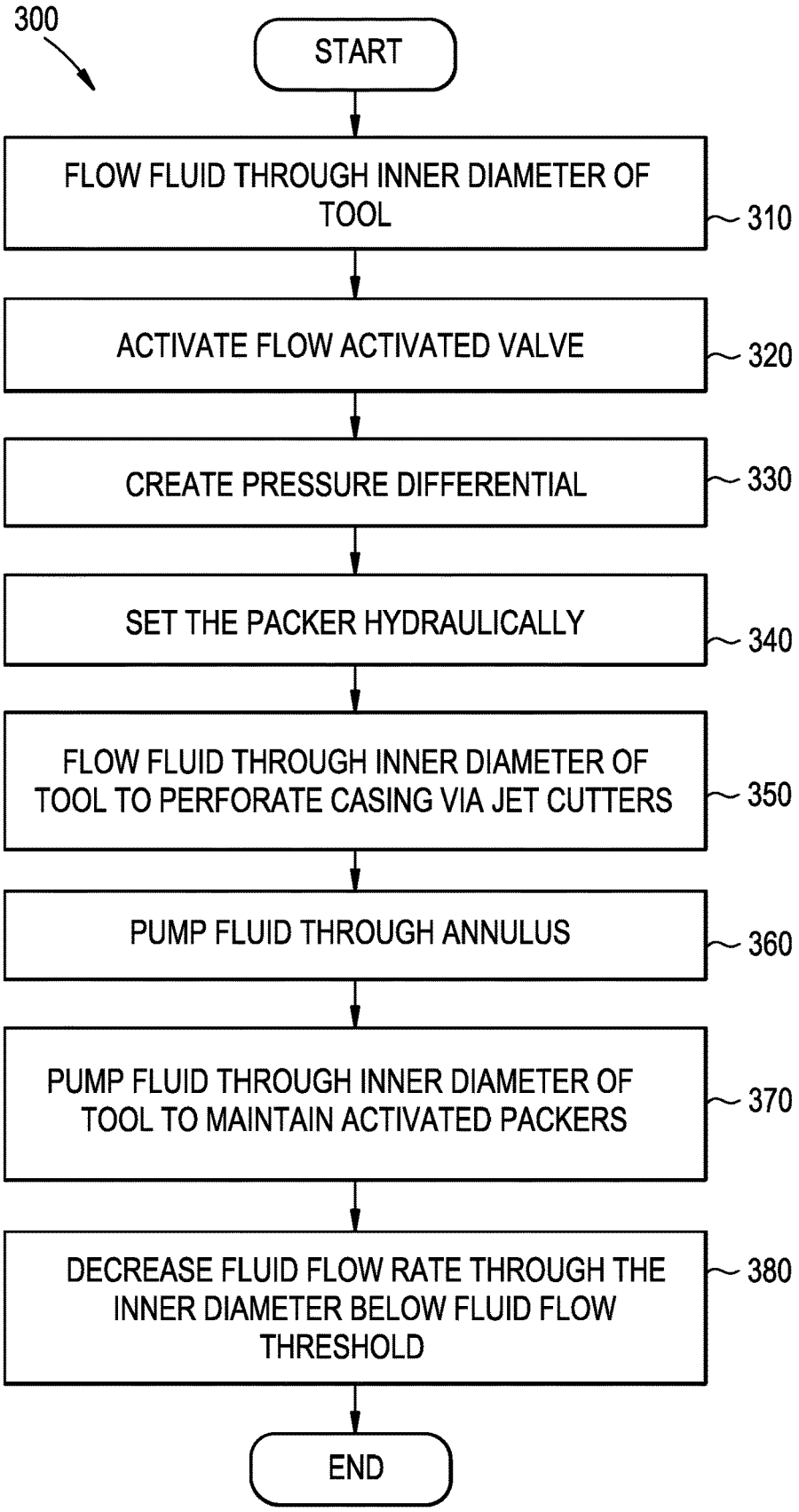
FIG. 3 depicts a method for a tool utilizing hydraulics to set packers and create perforations with the casing, according to an embodiment.

FIG. 3 depicts a method 300 for a system utilizing an inner diameter of a tool for jet cutting and hydraulically setting packer, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting. Furthermore, the operations of method 300 may be repeated for subsequent valves or zones in a well.

At operation 310, fluid may flow within an inner diameter of a tool.

At operation 320, responsive to the fluid flowing through the inner diameter of the tool at a flow rate above a fluid flow threshold, a flow activated valve may be activated. The flow activated valve may be activated by moving a flow activated valve to create a seal on an open end of the tool.

At operation 330, by activating the flow activated valve, pressure within the inner diameter of the tool may increase to create a pressure differential between the inner diameter of the tool and an annulus between the tool and a casing.

At operation 340, the packers may be hydraulically set based on the pressure differential. When the packers are set, the packers may extend across the annulus positioned between the tool and the casing.

At operation 350, fluid may be pumped through the inner diameter of the tool. The fluid flowing through the inner diameter of the tool may be utilized by jet cutters to focus the flowing fluid across the annulus to form perforations in the casing.

At operation 360, fluid may be pumped through the annulus to perform a fracturing or injection operation.

At operation 370, while the fluid is being pumped through the annulus at operation 360, fluid may simultaneously be pumped through the inner diameter of the tool At operation 380, the fluid flow rate through the inner diameter of the tool may decrease to be below a fluid flow threshold. Responsive to decreasing the fluid flow rate, the fluid flow valve may be unset, and the packers to be automatically un-set. Fluid may be then circulated or reverse circulated to through the tool bottom end. The tool may then be moved to a next zone for treatment, which may be a higher or a lower zone.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A fracturing system comprising:

a tool configured to be positioned within a casing, wherein an annulus is formed between the casing and the tool;

a hydraulically activated resettable packer configured to extend across the annulus responsive to creating a pressure differential between an inner diameter of the tool and the annulus to isolate a first portion of the annulus from a second portion of the annulus, wherein the first portion of the annulus extends from the hydraulically activated resettable packer to a surface level;

jet cutters configured to perforate the casing utilizing fluid flowing through the inner diameter of the tool while the hydraulically activated resettable packer extends across the annulus, wherein when annulus fluid flows through the first portion of the annulus in a first direction the inner diameter fluid simultaneously flows through the inner diameter in the first direction, wherein the inner diameter fluid flows through the inner diameter in the first direction to maintain the hydraulically activated resettable packer extended across the annulus.

2. The fracturing system of claim 1, wherein the pressure differential is created by flowing the inner diameter fluid through the inner diameter of the tool.

3. The fracturing system of claim 1, further comprising:

a flow activated valve that is configured to seal a distal end of the tool to create the pressure differential.

4. The fracturing system of claim 3, wherein the hydraulically activated resettable packer is positioned closer to the flow activated valve than the jet cutters.

5. The fracturing system of claim 1, wherein the pressure differential is created by flowing fluid through the inner diameter of the tool.

6. A fracturing system comprising: a tool configured to be positioned within a casing, wherein an annulus is formed between the casing and the tool; a hydraulically activated resettable packer configured to extend across the annulus responsive to creating a pressure differential between an inner diameter of the tool and the annulus; jet cutters configured to perforate the casing utilizing inner diameter fluid flowing through the inner diameter of the tool while the hydraulically activated resettable packer extends across the annulus, wherein the jet cutters and the hydraulically activated resettable packer utilize the inner diameter fluid, and annulus fluid is configured to flow through the annulus and into the perforations in the casing, wherein the inner diameter fluid and the annulus fluid simultaneously flow in a same direction.

7. A method for a fracturing system comprising:

positioning a tool within a casing;

forming an annulus between the casing and the tool;

setting a hydraulically activated resettable packer to extend across the annulus responsive to creating a pressure differential between an inner diameter of the tool and the annulus to isolate a first portion of the annulus from a second portion of the annulus, wherein the first portion of the annulus extends from the hydraulically activated resettable packer to a surface level;

perforating, the casing utilizing jet cutters, to perforate the casing utilizing inner diameter fluid flowing through the inner diameter of the tool while the hydraulically activated resettable packer extends across the annulus; and simultaneously flowing annulus fluid through the first portion of the annulus in a first direction and the inner diameter fluid through the inner diameter in the first direction, wherein the inner diameter fluid flows through the inner diameter in the first direction to maintain the hydraulically activated resettable packer extended across the annulus.

8. The method of claim 7, further comprising:

creating the pressure differential by flowing the inner diameter fluid through the inner diameter of the tool.

9. The method of claim 7, wherein the annulus fluid and the inner diameter fluid are different types of fluid.

10. The method of claim 7, further comprising:

sealing a distal end of the tool to create the pressure differential.

11. The method of claim 9, wherein the hydraulically activated resettable packer is positioned closer to the distal end of the tool than the jet cutters.

12. The method of claim 7, wherein the pressure differential is created by flowing fluid through the inner diameter of the tool.

13. The method of claim 7, wherein the jet cutters and the hydraulically activated resettable packer utilize the inner diameter fluid, and the annulus fluid is configured to flow through the annulus and into the perforations in the casing.

* * * * *